US010074944B2

(12) United States Patent
Bhatawadekar et al.

(10) Patent No.: US 10,074,944 B2
(45) Date of Patent: Sep. 11, 2018

(54) ARC SUPPRESSION CONNECTOR

(71) Applicant: Littelfuse, Inc., Chicago, IL (US)

(72) Inventors: Kedar V. Bhatawadekar, Santa Clara, CA (US); Mario G. Sepulveda, Newark, CA (US); Jason Larson, San Lorenzo, CA (US)

(73) Assignee: Littelfuse, Inc., Chicago, IL (US)

( * ) Notice: Subject to any disclaimer, the term of this patent is extended or adjusted under 35 U.S.C. 154(b) by 201 days.

(21) Appl. No.: 15/076,246

(22) Filed: Mar. 21, 2016

(65) Prior Publication Data

US 2017/0271824 A1 Sep. 21, 2017

(51) Int. Cl.
*H01R 13/66* (2006.01)

(52) U.S. Cl.
CPC ..... *H01R 13/6633* (2013.01); *H01R 13/6608* (2013.01)

(58) Field of Classification Search
CPC H01R 13/66; H01R 13/6608; H01R 13/6633; H01H 9/30; H01H 9/38; H01H 2033/163
See application file for complete search history.

(56) References Cited

U.S. PATENT DOCUMENTS 5,737,160 A 4/1998 Duffy
6,072,673 A * 6/2000 Chen ..... H01H 33/123 361/13
6,181,541 B1 1/2001 Souri et al.
6,659,783 B2 12/2003 Cooper et al.
7,616,420 B2 11/2009 Slater et al.

OTHER PUBLICATIONS

ISR and Written Opinion dated May 18, 2017, in corresponding PCT/US2017/019685.

* cited by examiner

*Primary Examiner* — Jeffrey Shin

(57) ABSTRACT

A circuit includes a connector having first and second mateable portions. Each portion includes at least two terminals configured to mechanically engage at least two terminals of the other portion. The two terminals within the first and second portions are arranged so that as the first and second portions are mated, a first terminal of the first portion and a first terminal of the second portions come into contact before respective second terminals of the first and second portions. The circuit also includes a polymeric positive temperature coefficient (PPTC) device with a first terminal in electrical communication with the first terminal of the first portion and a second terminal in electrical communication with the second terminal of the first portion. A power terminal is in electrical communication with the second terminal of the first portion and is configured to be connected to a power source. A load terminal is in electrical communication with the first and second terminals of the second portion and is configured to be connected to a load.

10 Claims, 7 Drawing Sheets

ARC SUPPRESSION CONNECTOR

BACKGROUND

Field

The present invention relates generally to connectors for coupling electrical wires. More specifically, the present invention relates to an arc suppression connector.

Description of Related Art

Electrical connectors are typically used to connect various components to one another. For example, in the manufacture of an automobile numerous sensors, actuators, etc., are connected to a wiring harness via a connector of some type. This streamlines the manufacturing process and facilitates replacement of the components should they fail.

During replacement of a component, an operator may not de-energize the wires prior to removal of the component, which can sometimes be a problem, especially where the component being disconnect has a relatively high inductance. In these cases, removal of the component while the component is energized may result in arcing within the connector. The arcing in turn leads to pitting and carbonization of the terminals, which reduces the current carrying capacity of the terminals.

Arcing has not historically been an issue in automobiles because typical automobiles operate at 12 volts, which is relatively low. However, auto manufactures have recently begun adapting newer automobiles to operate at 48 volts to allow for the use of higher gauge/lower weight wires to thereby improve overall fuel efficiency. The higher voltage operation exacerbates issues with arcing within the connectors.

Other problems with existing motor assemblies will become apparent in view of the disclosure below.

SUMMARY

In one aspect, a circuit includes a connector having first and second mateable portions. Each portion includes at least two terminals configured to mechanically engage at least two terminals of the other portion. The two terminals within the first and second portions are arranged so that as the first and second portions are mated, a first terminal of the first portion and a first terminal of the second portions come into contact before respective second terminals of the first and second portions. The circuit also includes a polymeric positive temperature coefficient (PPTC) device with a first terminal in electrical communication with the first terminal of the first portion and a second terminal in electrical communication with the second terminal of the first portion. A power terminal is in electrical communication with the second terminal of the first portion and is configured to be connected to a power source. A load terminal is in electrical communication with the first and second terminals of the second portion and is configured to be connected to a load. When the first and second portions are separated from one another after having been initially mated together, the respective second terminals of the first and second portions separate, at which point the circuit allows current to flow from the power terminal to the load terminal via the PPTC device and the respective first terminals of the first and second portions. When current flows through the PPTC device, the resistance of the PPTC device gradually increases to reduce the current flow to the load terminal.

In a second aspect, a circuit includes a connector having first and second mateable portions. Each portion includes at least two terminals configured to mechanically engage at least two terminals of the other portion. The two terminals within the first and second portions are arranged so that as the first and second portions are mated, a first terminal of the first portion and a first terminal of the second portions come into contact before respective second terminals of the first and second portions. The circuit also includes a polymeric positive temperature coefficient (PPTC) device with a first terminal in electrical communication with the first terminal of the first portion and a second terminal in electrical communication with the second terminal of the first portion. A shunt circuit is connected across the PPTC device and is configured to prevent nuisance activation of the PPTC device. A power terminal is in electrical communication with the second terminal of the first portion and is configured to be connected to a power source. A load terminal is in electrical communication with the first and second terminals of the second portion and is configured to be connected to a load. When the first and second portions are separated from one another after having been initially mated together, the respective second terminals of the first and second portions separate, at which point the circuit allows current to flow from the power terminal to the load terminal via the PPTC device and the respective first terminals of the first and second portions. When current flows through the PPTC device, the resistance of the PPTC device gradually increases to reduce the current flow to the load terminal.

DETAILED DESCRIPTION

Figure 1:
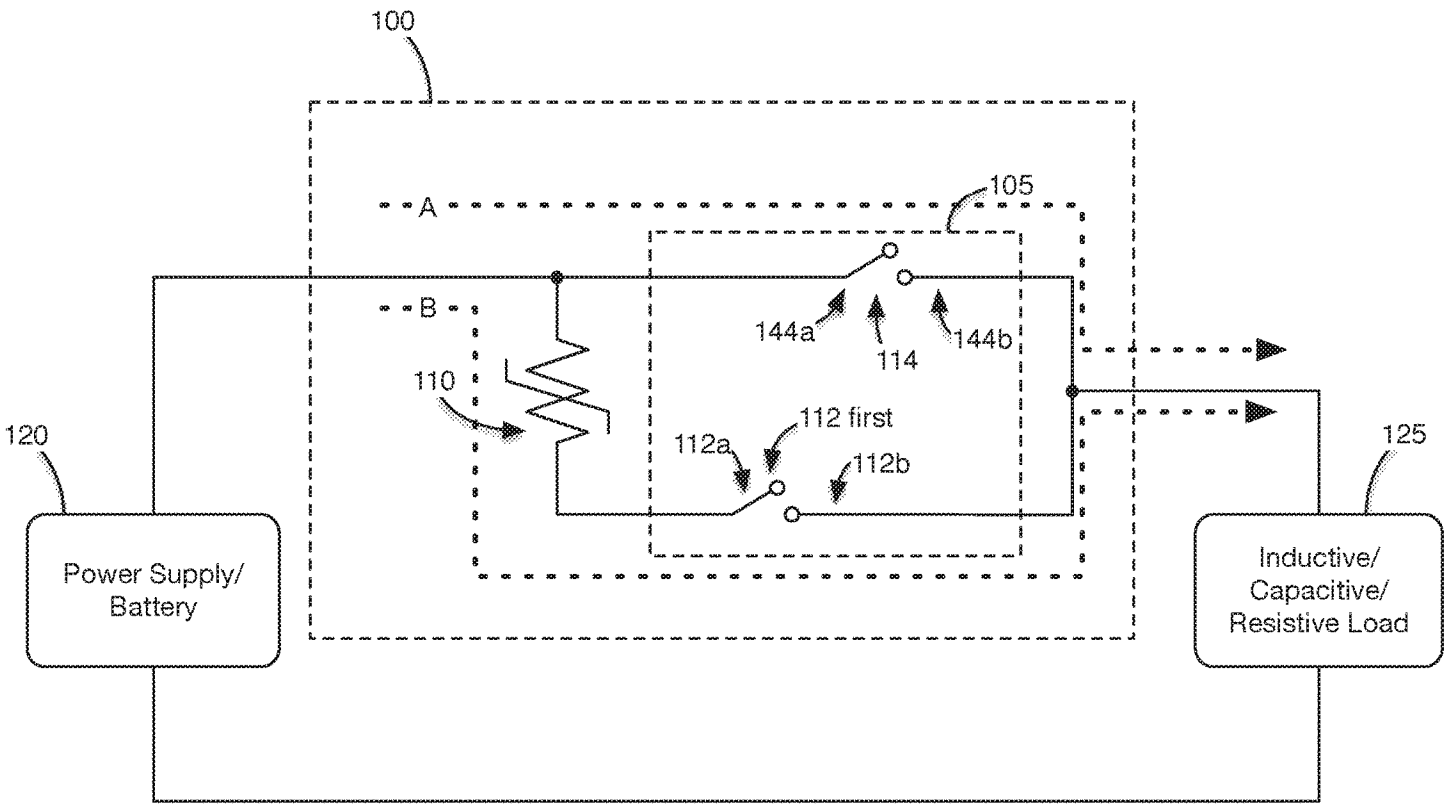
FIG. 1 illustrates a first exemplary arc suppression connector circuit.

FIG. 1 illustrates an exemplary arc suppression connector circuit 100. The circuit 100 includes a connector 105 and a polymeric positive temperature coefficient (PPTC) device. The connector circuit 100 is illustrated as coupling a power supply 110 to a load 115. The load 115 may be resistive or may have a combination of resistive and capacitive or resistive and an inductive component.

Figure 2A:
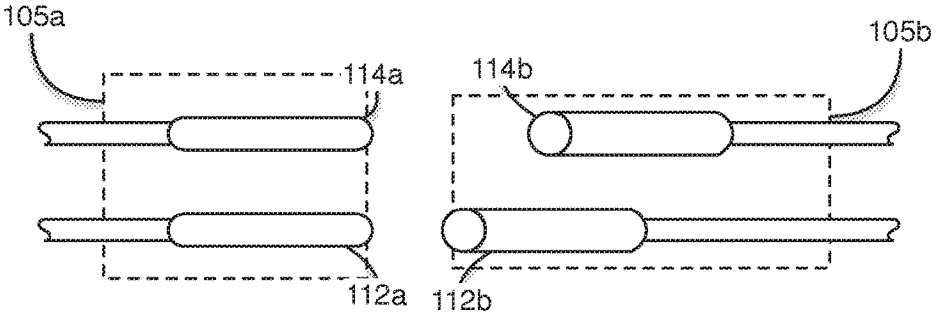
FIGS. 2A-C illustrate an exemplary connector that may be used in connection with the first exemplary arc suppression.
Figure 2B:
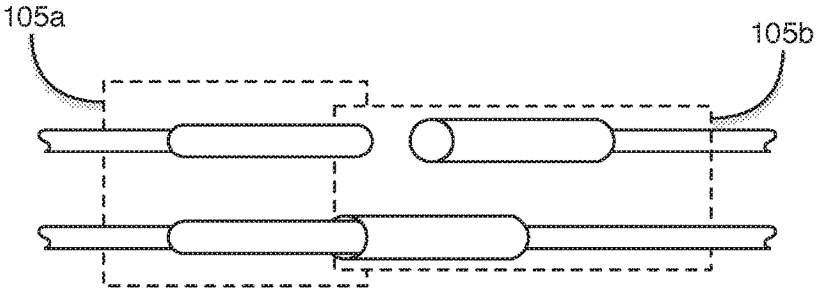
Figure 2C:
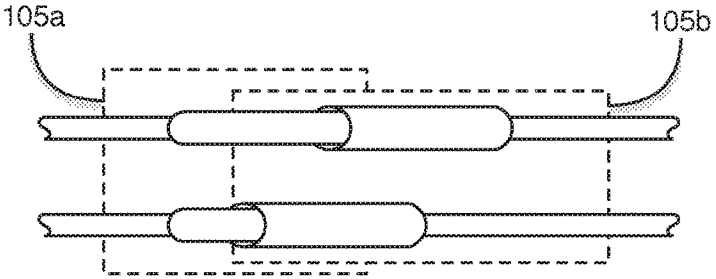

As illustrated in FIGS. 2A-C, the connector 105 includes first and second mateable portions 105*ab*. The PPTC device may be integrated with either of the portions 105*ab* or it could be a part of the circuit 100 outside the connector housing to maintain design flexibility. Each connector portion 105*ab* includes a bypass terminal 112*ab* and a main terminal 114*ab*, though the number of terminals may be different. The terminals 112*a*, 114*a* in the first connector portion 105*a* are configured to mechanically engage the terminals 112*b*, 114*b* in the second connector portion 105*b*. The terminals within the first and second connector portions

105*ab* are arranged so that as the first and second connector portions 105*ab* are mated, the bypass terminals 112*ab* come into contact first, as illustrated in FIG. 2B. When the connector portions 105*ab* are fully mated/engaged with one another, the main terminals 114*ab* engage one another as well, as illustrated in FIG. 2C. It should be understood that the terminals may be arranged in a manner different than the manner illustrated in FIG. 1 while still achieving the desired result of having certain terminals engage before other terminals become engaged.

Referring back to FIG. 1, a first terminal of the PPTC device 110 is in electrical communication with the bypass terminal 112*a* disposed within the first connector portion 105*a*. A second terminal of the PPTC device 110 is in electrical communication with the main terminal 114*a* disposed within the first connector portion 105*a*. The PPTC 110 device may include a material that exhibits non-linear changes in resistance with changes in temperature. For example, at room temperature, the PPTC device 110 may have a resistance of about 1 ohm. At a temperature of 165 C, the PPTC device 110 may have a resistance of about 1.0E+6 ohms. In the general, the temperature of the PPTC device 110 increases as current flows through the PPTC device 110. Some considerations made in the selection of the PPTC device include the amount of current expected to flow to the load 125 and the desired activation time of the PPTC device 110. The activation corresponds to the amount of time the PPTC device 110 requires to transition from a low resistance state to a resistance sufficient to limit or eliminate arcing within the connector 105, as described in more detail below.

In operation, the first and second connector portions 105*ab* are initially fully mated to one another, as illustrated in FIG. 2C. In this state, current follows path A form the power supply 120 through the main terminals 114*ab* of the connector 105, to the load 125. In this configuration, the voltage across the PPTC device 110 is essentially 0. Therefore, little to no heating occurs within the PPTC device 110.

Next, the respective connector portions 105*ab* are separated from one another. During separation, the state of the connector 105 transitions to the configuration illustrated in FIG. 2B, and then to the configuration of FIG. 2A. In the configuration of FIG. 2B, the main terminals 114*ab* are separated from one another while the bypass terminals 112*ab* remain connected. In this state, the current follows path B from the power supply 110, through the PPTC device 110, to the load 125. When current flows through the PPTC device 110, the resistance of the PPTC device 110 gradually increases, which in turn gradually decreases the current flow to the load 125 until the current becomes essentially zero.

By the time the connector 105 transitions to the configuration of FIG. 2A (i.e., the completely separated configuration), the current flow to the load has decreased to the point that little to no arcing will occur within the connector 105.

As noted above, the PPTC device 110 may be selected so that the resistance of the PPTC device 110 increases to a resistance needed to eliminate arcing within an expected amount of time that it will take an operator to pull the respective connector portions 105*ab* apart. For example, an operator may be able to open a connector within 20 mSec. For a load current of ~15 Amps, a PPTC device with an activation current of 500 to 700 mA and activation time of <5 mSec may be selected.

Figure 3:
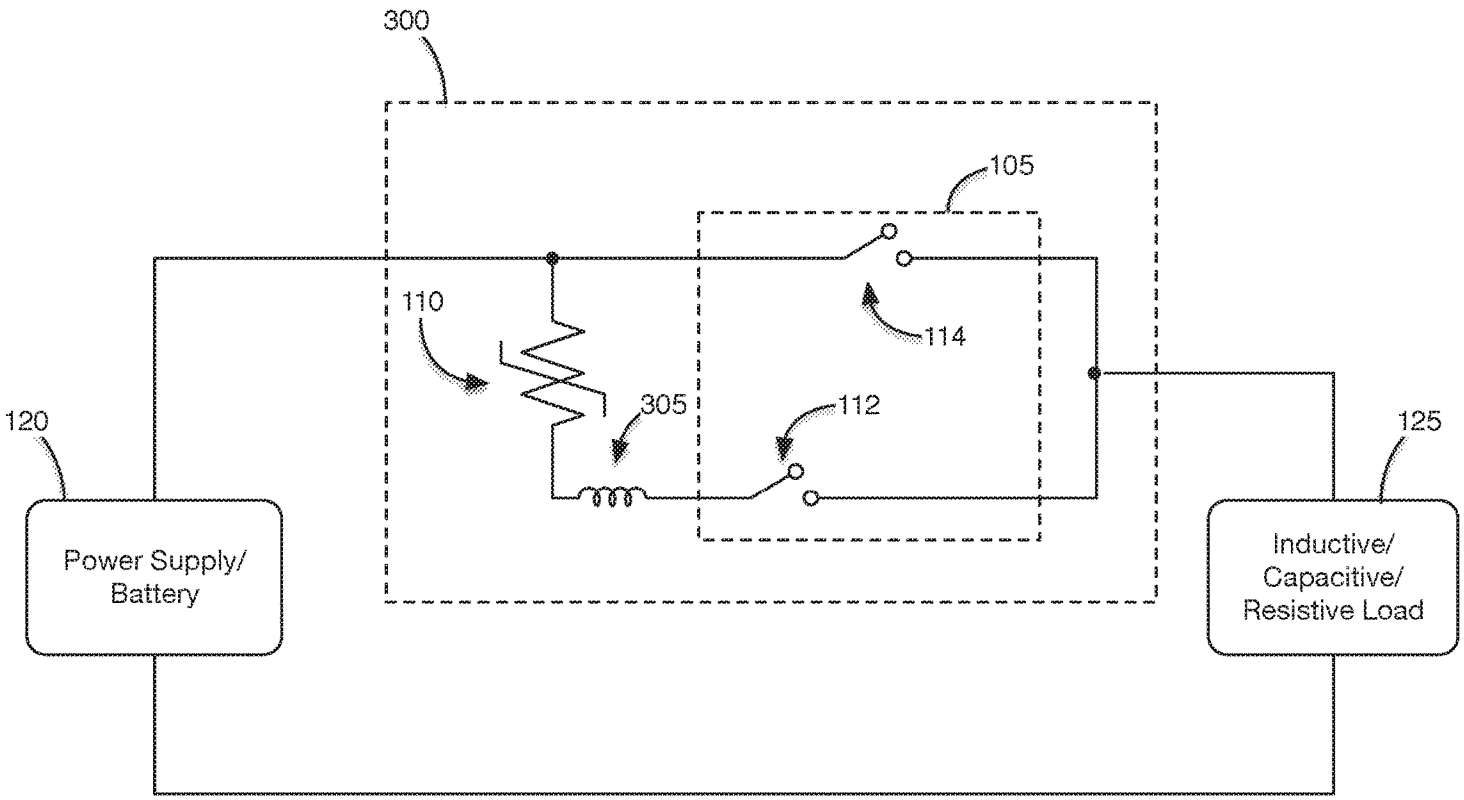
FIG. 3 illustrates a second exemplary arc suppression connector circuit having a delayed activation response.

FIG. 3 illustrates a second exemplary embodiment of an arc suppression connector circuit 300 that includes the components of the circuit 100 illustrated in FIG. 1 along with an inductor 305. The inductor 305 is inserted between one end of the PPTC device 110 and the bypass terminal 112*a* in the first portion 105*a* of the connector 100 and may be integrated within the first portion 105*a* along with the PPTC device 110.S The inductor 305 is provided to minimize nuisance activation of the PPTC device 110 when the first and second connector portions 105*ab* are brought together. More precisely the inductor 305 delays the onset of current flow through the PPTC device 110, which would otherwise activate the PPTC device 110, as the connector passes through the configuration of FIG. 2C. Without such a delay, the PPTC device may activate (i.e., have a high resistance) shortly after the respective connector portions are mated. Thus, separating the connector portions while the PPTC device 110 is in this state may result in arcing. The inductor 305 is provided to reduce or eliminate this possibility.

Figure 4:
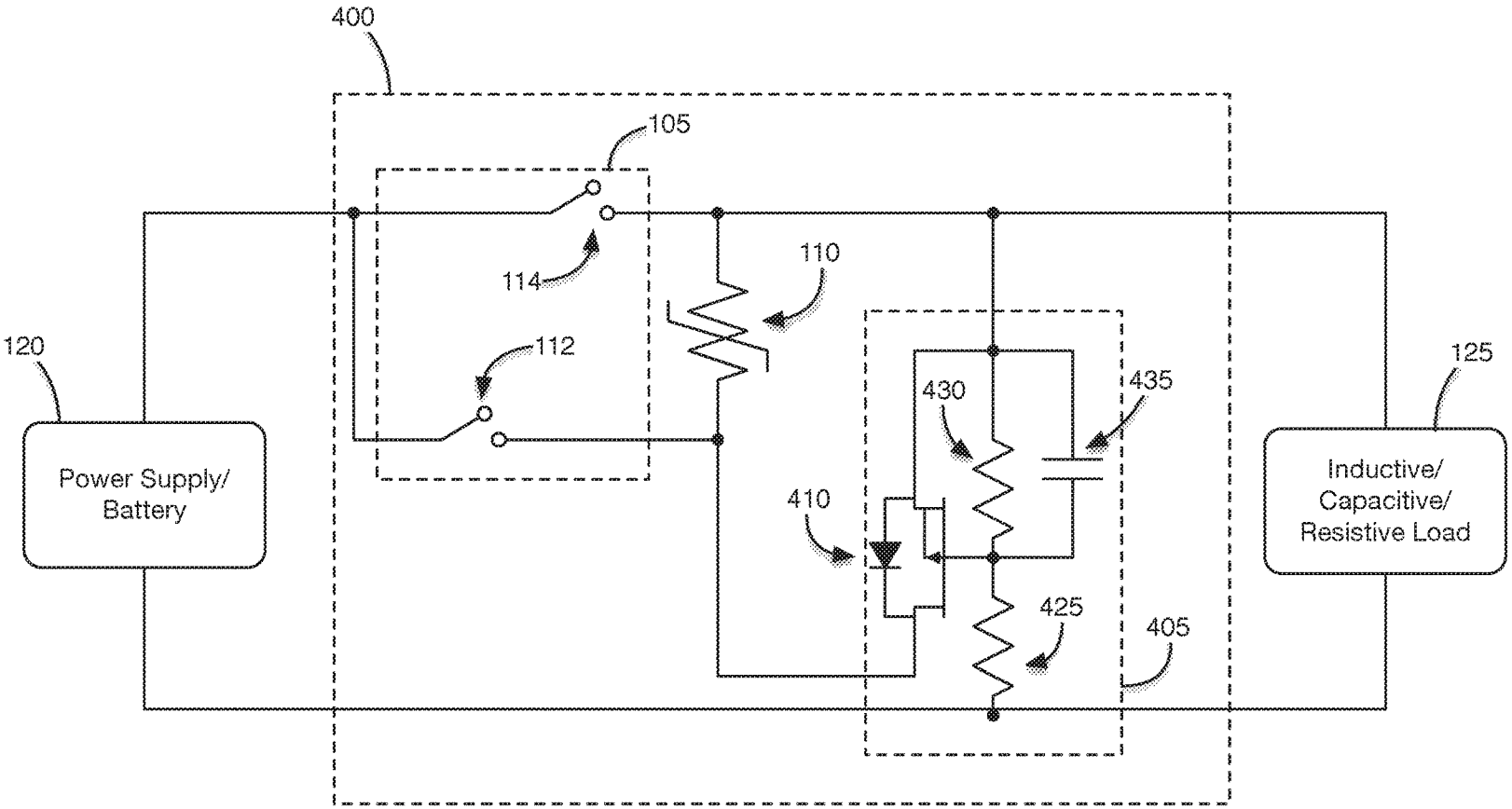
FIG. 4 illustrates a third exemplary arc suppression connector circuit having a delayed activation response.

FIG. 4 illustrates a third exemplary embodiment of an arc suppression connector circuit 400 a connector 105 and a polymeric positive temperature coefficient (PPTC) device such as those described above.

In the third exemplary embodiment, a first terminal of the PPTC device 110 is in electrical communication with the bypass terminal 112*b* disposed within the second connector portion 105*b*. A second terminal of the PPTC device 110 is in electrical communication with the main terminal 114*b* disposed within the second connector portion 105*b*.

A shunt circuit 405 is provided across the PPTC device 110. The shunt circuit 405 is configured to prevent nuisance activation of the PPTC device 110 when the first and second connector portions 105*ab* are mated to one another. The shunt circuit operates by momentarily shorting the PPTC device 110 just after the bypass terminals 112*ab* of the connector 105 are brought together, as illustrated in FIG. 2B. The shunt circuit 405 and the PPTC device 110 may be integrated within the second connector portion 105*b*.

In one implementation, the shunt circuit 405 includes a FET 410 that functions as a switch. The source of the FET 410 may be coupled to the power supply side of the PPTC device 110 and the drain of the FET 410 may be coupled to the load side of the PPTC device 110. A first resistor 425 is connected between the gate of the FET 410 and a ground node. A second resistor 430 is connected between the gate of the FET 410 and the load side of the PPTC device 110. A capacitor 435 is connected in parallel with the second resistor.

In operation, the voltage across the capacitor 435 is initially 0 volts, which in turns means that the gate to source voltage of the FET 410 is zero. In this mode, the FET 410 is turned on and allows current to flow from the drain to the source. Thus, when the bypass terminals 112*ab* of the respective connector portions 105*ab* are brought together, current will flow from the power supply 120, through the bypass terminals 112*ab*, through the FET 410, and to the load 125, rather than through the PPTC device 110 to the load 125.

At his stage of operation, the voltage across the capacitor 435 increases to a point at which the FET 410 is turned off. Once the FET 410 is turned off, current may flow through the PPTC device 110 and the PPTC device 110 operates during separation of the respective connector portions 105*ab* as described above.

The values of the resistors 425, 430 and capacitor 435 may be selected to delay activation of the PPTC device 110 until the respective connector portions 105*ab* ma be fully mated. For example, the components may be selected to introduce a delay of about one second.

Figure 5:
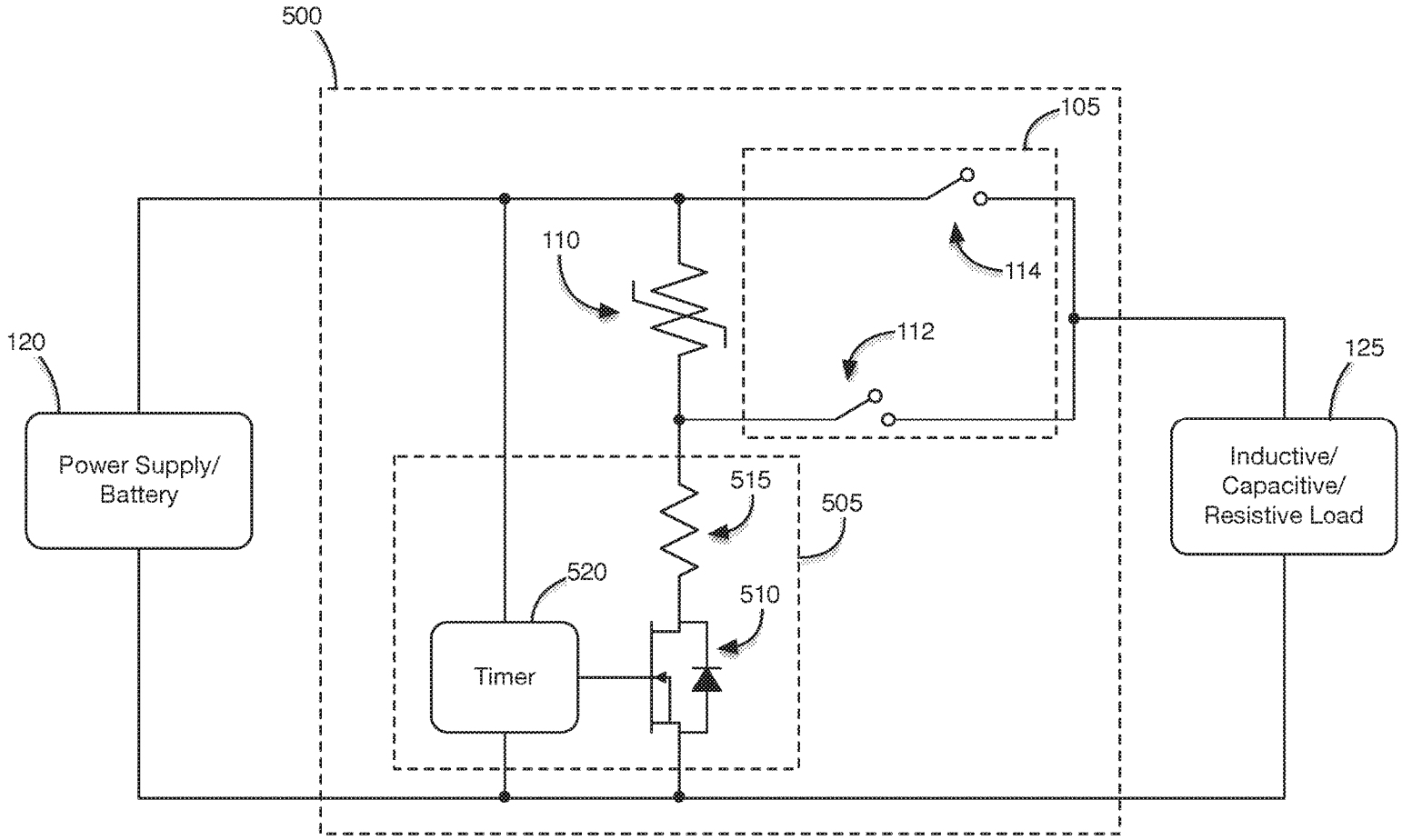
FIG. 5 illustrates a fourth exemplary arc suppression connector circuit having a pre-heater circuit triggered by a timer.

FIG. 5 illustrates a fifth exemplary embodiment of an arc suppression connector circuit 500 that includes the components of the circuit illustrated in FIG. 1. The connector circuit 500 also includes a pre-heater circuit 505 that allows the connector circuit 500 to suppress arcing when used with loads 125 that do not draw enough current to fully activate the PPTC device 110 in the required time. The pre-heater circuit 505 and the PPTC device 110 may be integrated within the first connector portion 105*a*.

The pre-heater circuit 505 is configured to "pre-heat" the PPTC device 110 by allowing a bias current to flow through the PPTC device 110 for a specified amount of time. The current flowing through the PPTC device 110 equals the sum of the bias current and the current flowing through the load 125. The bias current causes the resistance of the PPTC device 110 to increase to just below the point of activation. For example, the bias current may be about 200 mA, which increases the resistance of the PPTC device 110 to about 1000 ohms. When the load current flows through the PPTC device 110, the resistance of the PPTC device 110 increases to a point at which the amount of current flowing to the load decreases to a negligible amount.

In one implementation, the pre-heater circuit 505 includes a FET 510 that functions as a switch. The source of the FET 510 may be coupled to a ground node and the drain may be coupled to the terminal of the PPTC device 110 that is coupled to the bypass terminal 112*a* disposed in the first connector portion 105*a* via a resistor 515. The value of the resistor 515 is selected to limit the bias current flowing though the PPTC device 110 when the FET 510 is switched on. In one exemplary implementation, the value of the resistor 515 may be about 12 ohms. In this case, a power supply voltage of 48V will cause 4 A current to flow through the PPTC device 110.

The pre-heater circuit 505 also includes a timer circuit 520 configured to turn the FET 510 on for a specified duration of time to thereby allow the temperature of the PPTC device 110 to reach a desired operating point. The timer circuit 520 may be configured to turn the FET 510 on for about 10 mSec after the first and second connector portions are mated to one another, as in FIG. 2C.

Figure 6:
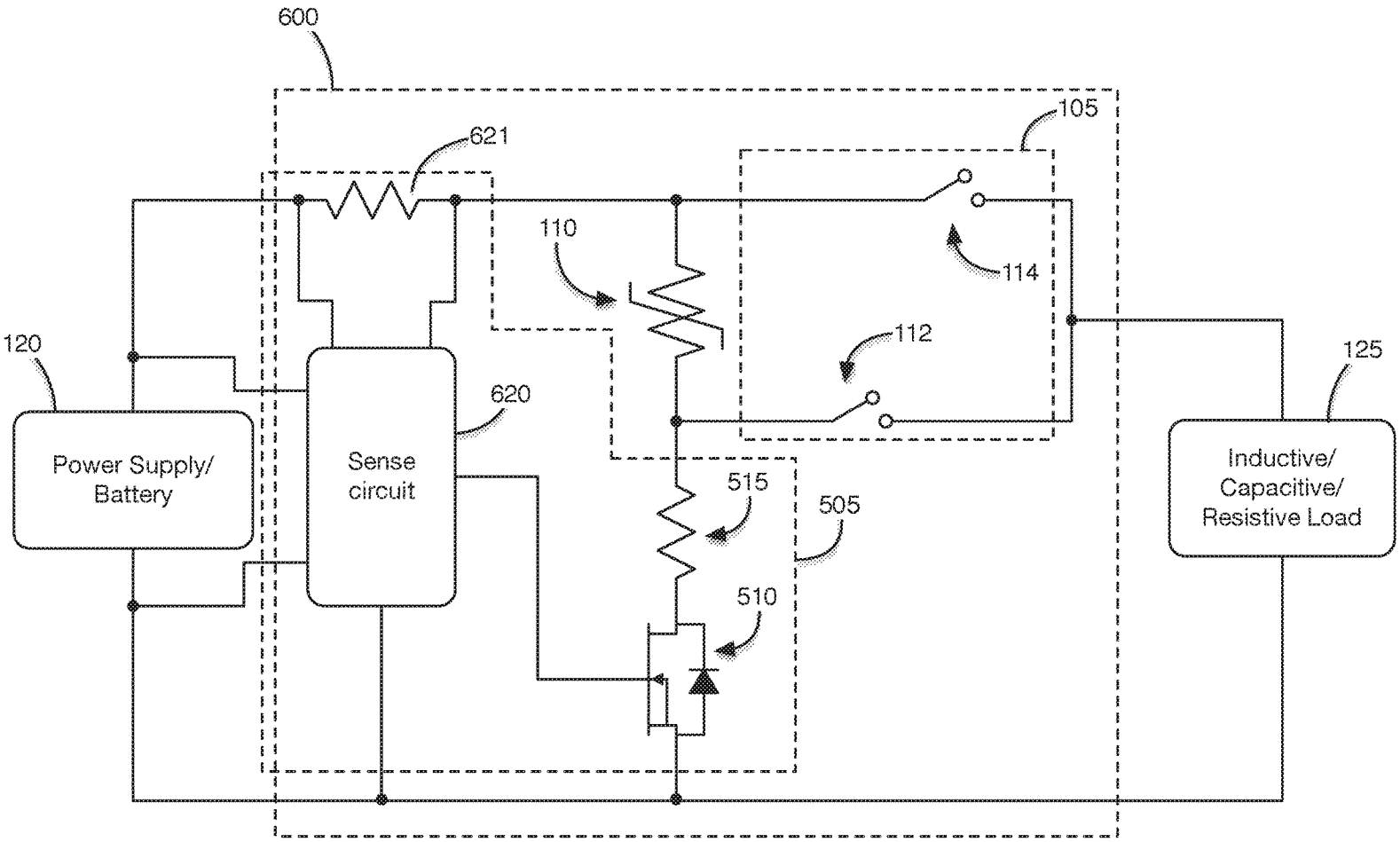
FIG. 6 illustrates a fifth exemplary arc suppression connector circuit having a pre-heater circuit triggered by a current sense circuit.
Figure 7:
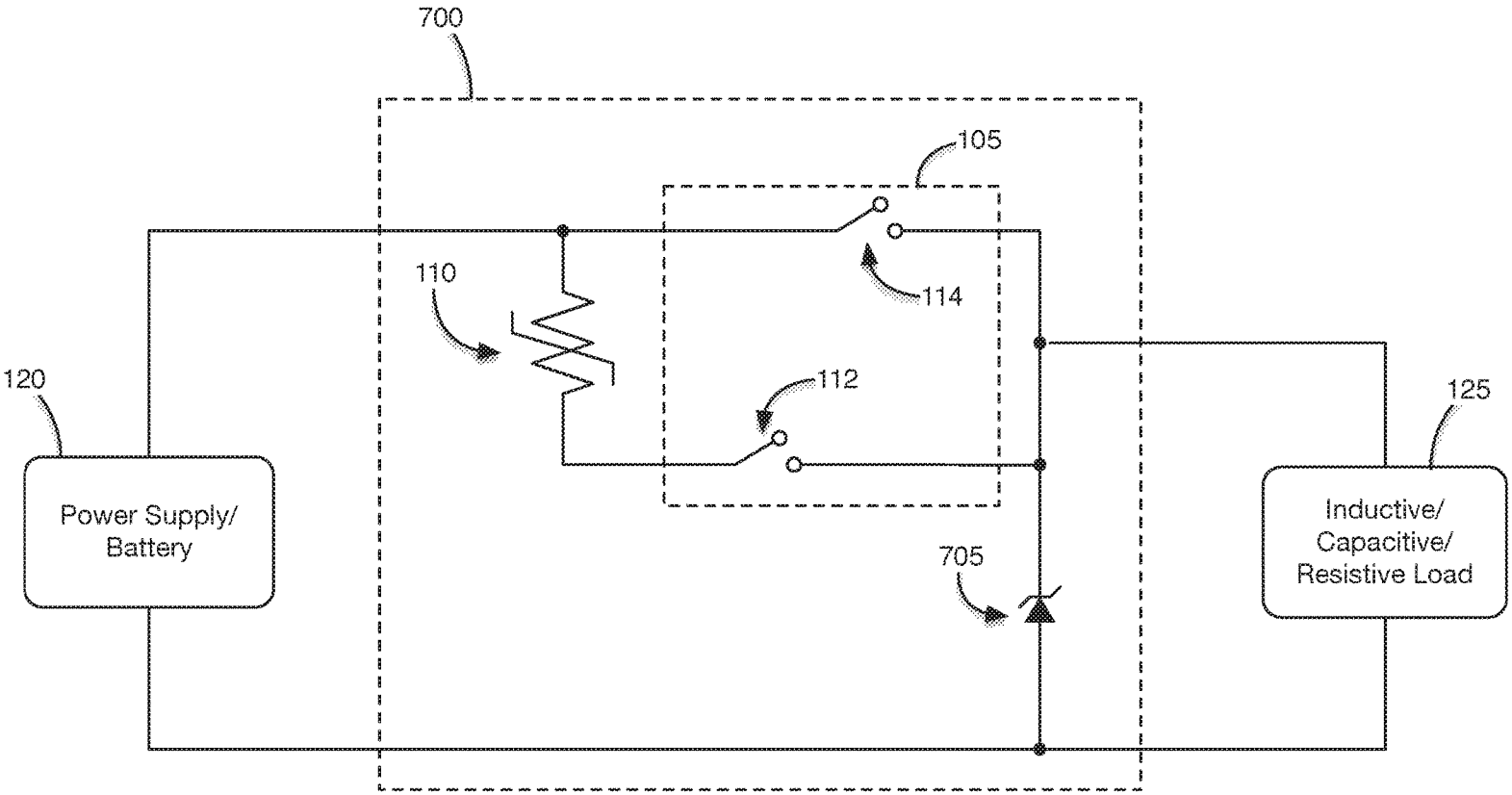
FIG. 7 illustrates a fifth exemplary arc suppression connector circuit having an over voltage trigger circuit.

FIG. 6 illustrates a sixth exemplary embodiment of an arc suppression connector circuit 600 that includes the components of the circuit illustrated in FIG. 1. The connector circuit 600 also includes a pre-heater circuit 605 that allows the connector circuit 600 to suppress arcing when used with loads 125 that do not draw enough current to fully activate the PPTC device 110 in the required time. The pre-heater circuit 505 and the PPTC device 110 may be integrated within the first connector portion 105*a*.

The function of the pre-heater circuit 605 is similar to that of the pre-heater circuit 505 illustrated in FIG. 5. However, the pre-heater circuit 605 includes a current sense circuit 520 rather than a timer. The current sense circuit 620 is configured to sense a relatively small current flow through a sense resistor 621 and to turn the FET 510 on when current is detected to thereby allow the temperature of the PPTC device 110 to reach a desired operating point. The current sense circuit 620 may be may be configured to turn the FET 510 when a current flow of about xx flows through the sense resistor 621.

FIG. 6 illustrates a sixth exemplary embodiment of an arc suppression connector circuit 600 that includes the components of the circuit illustrated in FIG. 1 along with a diode 605. The cathode of the diode 605 is coupled to the load side of the connector 105 and the anode of the diode 605 is coupled to a ground node. The PPTC device 110 may be integrated within the first connector portion 105*a*, while the diode 605 may be integrated within the second connector portion 105*b*.

The diode 605 may correspond to a transient-voltage-suppression diode (TVS). A TVS is a type of diode ideally suited to protect against over voltage conditions. In operation, when the connector 105 transitions to the configuration of FIG. 2B, a high voltage may begin to develop on the load side of the connector 105 at which point the diode 605 may trip and effectively become a short to the ground node. This causes current to flow from the power supply 120, through the PPTC device 110, through the diode 605, and then to the ground node. The current flow through the PPTC device 110 causes the PPTC device 110 to start to activate.

While an arc suppression connector has been described with reference to certain embodiments, it will be understood by those skilled in the art that various changes may be made and equivalents may be substituted without departing from the spirit and scope of the claims of the application. For example, while the main and bypass terminals 112, 114 are described as being within a connector, it should be understood that the other components (e.g., the PPTC device, FET transistors, resistors, etc.) may be disposed within the first or second connector portions 105*ab* as well.

Other modifications may be made to adapt a particular situation or material to the teachings disclosed above without departing from the scope of the claims. For example, the PPTC device 110 may be selected to activate based upon different load current conditions to thereby provide different connectors suitable for different operating currents. Therefore, the claims should not be construed as being limited to any one of the particular embodiments disclosed, but to any embodiments that fall within the scope of the claims.

What is claimed is:

1. A circuit comprising:

a connector having first and second mateable portions, each portion comprising at least two terminals configured to mechanically engage the at least two terminals of the other portion, wherein the at least two terminals within the first and second portions are arranged so that as the first and second portions are mated, respective first terminals of the first and second portions come into contact before respective second terminals of the first and second portions;

a polymeric positive temperature coefficient (PPTC) device with a first terminal in electrical communication with the first terminal of the first portion and a second terminal in electrical communication with the second terminal of the first portion;

a power terminal in electrical communication with the second terminal of the first portion configured to be connected to a power source; and a load terminal in electrical communication with the first and second terminals of the second portion configured to be connected to a load, wherein as the first and second portions are separated from one another after having been initially mated together, the respective second terminals of the first and second portions separate, at which point the circuit allows current to flow from the power terminal to the load terminal via the PPTC device and the respective first terminals of the first and second portions, wherein when current flows through the PPTC device, a resistance of the PPTC device gradually increases to reduce the current flow to the load terminal;

the circuit further comprising a bias circuit configured to increase an amount of current flowing through the PPTC device when the first and second portions start to separate to thereby facilitate activation of the PPTC device when the current to the load is insufficient to activate the PPTC device.

2. The circuit according to claim 1, wherein the PPTC device is disposed within the first portion.

3. The circuit according to claim 1, further comprising an inductor coupled between the first terminal of the PPTC device and the first terminal of the first portion, wherein the inductor delays the current flow through the PPTC device to thereby prevent nuisance activation of the PPTC device as the first and second portions are mated.

4. The circuit according to claim 1, wherein the PPTC bias circuit comprises a delay circuit configured to momentarily activate a switch coupled between the first terminal of the PPTC device and a ground node to thereby cause current to momentarily flow through the PPTC bias circuit and the switch.

5. The circuit according to claim 1, further comprising an arc suppression component connected to the first and second terminals of the second portion that allows current to flow through the PPTC device when the arc suppression component is triggered.

6. The circuit according to claim 5, wherein the arc suppression component corresponds to a transient-voltage-suppression diode.

7. A circuit comprising:

a connector having first and second mateable portions, each portion comprising at least two terminals configured to mechanically engage the at least two terminals of the other portion, wherein the at least two terminals within the first and second portions are arranged so that as the first and second portions are mated, respective first terminals of the first and second portions come into contact before respective second terminals of the first and second portions;

a polymeric positive temperature coefficient (PPTC) device with a first terminal in electrical communication with the first terminal of the second portion and a second terminal in electrical communication with the second terminal of the second portion;

a shunt circuit connected across the PPTC device configured to prevent nuisance activation of the PPTC device, a power terminal in electrical communication with the second terminal of the first portion configured to be connected to a power source; and a load terminal in electrical communication with the first and second terminals of the second portion configured to be connected to a load, wherein as the first and second portions are separated from one another after having been initially mated together, the respective second terminals of the first and second portions separate, at which point the circuit allows current to flow from the power terminal to the load terminal via the PPTC device and the respective first terminals of the first and second portions, wherein when current flows through the PPTC device, a resistance of the PPTC device gradually increases to reduce the current flow to the load terminal;

wherein the shunt circuit comprises a delay circuit configured to momentarily activate a switch coupled across the first and second terminals of the PPTC to thereby cause current to momentarily flow through the shunt when the first and second portions are mated together.

8. The circuit according to claim 7, where the shunt circuit is configured to deactivate the switch after the first and second portions are mated together.

9. The circuit according to claim 7, wherein the PPTC device is disposed within the second portion.

10. The circuit according to claim 7, wherein the PPTC device and shunt circuit are disposed within the second portion.

* * * * *